United States Patent [19]

Raschle

[11] 4,040,242

[45] Aug. 9, 1977

[54] TWIST TUBE FOR FALSE-TWISTING DEVICES

[75] Inventor: Josef Raschle, Butschwil, Switzerland

[73] Assignee: Heberlein Maschinenfabrik AG, Switzerland

[21] Appl. No.: 745,577

[22] Filed: Nov. 29, 1976

[30] Foreign Application Priority Data

Dec. 11, 1975 Switzerland ..... 16091/75

[51] Int. Cl.[2] ..... D02G 1/06

[52] U.S. Cl. ..... 57/77.3

[58] Field of Search ..... 57/77.3, 77.45, 157 TS

[56] References Cited

U.S. PATENT DOCUMENTS

| | | | |
|---|---|---|---|
| 2,463,619 | 3/1949 | Kunzle | 57/77.3 |
| 3,232,036 | 2/1966 | Scragg | 57/77.3 |
| 3,475,895 | 11/1969 | Raschle | 57/77.3 |
| 3,778,991 | 12/1973 | Brummer | 57/77.3 |
| 3,983,686 | 10/1976 | Raschle | 57/77.3 |

FOREIGN PATENT DOCUMENTS

| | | | |
|---|---|---|---|
| 1,477,791 | 3/1967 | France | 57/77.3 |
| 1,049,776 | 11/1966 | United Kingdom | 57/77.3 |

*Primary Examiner*—Donald Watkins

*Attorney, Agent, or Firm*—Larson, Taylor and Hinds

[57] ABSTRACT

A twist tube for a false-twisting device for texturing textile yarns has an enlarged end in which the bore has an oblong cross-section with both the major and minor axes substantially longer than the bore of the main portion of the tube. The thread guide pin extends in the direction of the minor axis between flat sides of the bore which are joined at each end by arcuate sides. Two circular, coaxial openings extend from outside the enlarged end to the arcuate sides. The oblong shape and these openings assist the threading of the twist tube. The thread guide pin is displaced laterally with respect to the longitudinal axis of the main portion of the tube by a fraction of the pin diameter. The axis of the openings, which is perpendicular to the pin axis, is displaced from the pin axis by a similar fraction, towards the main portion of the tube.

3 Claims, 4 Drawing Figures

TWIST TUBE FOR FALSE-TWISTING DEVICES

FIELD OF THE INVENTION

The present invention relates to a twist tube for false-twisting devices for texturing textile yarns.

DESCRIPTION OF THE PRIOR ART

The development of false-twisting devices for texturing textile yarns tends to achieve higher and higher revolution speeds of the twist tube in order to increase in this manner the yarn advance speed and therefore the production quantity of textured yarns.

False-twisting devices are already known which comprise two axially parallel rollers and twist tubes in tangential contact therewith, one of the rollers being driven and the other idling as a guiding roller and the twist tube being pressed against the rollers by means of magnets.

Furthermore, twist tubes for false-twisting devices of this kind are known which comprise, at one end of the twist tube or in the middle thereof, a portion of a diameter larger than the diameter of the twist tube, in the axial bore of which there is arranged a transverse guide pin of hard material, for example of sapphire. In this case, the yarn to be textured, which passes through the longitudinal bore of the twist tube, is wrapped once around the pin.

With the above described known false-twisting devices, it is already possible to achieve revolution speeds of the twist tube of several hundred thousand r.p.m. In order to further increase these revolution speeds, it is necessary to produce twist tubes having relatively small dimensions. The use of twist tubes having small dimensions has, on the other hand, the disadvantage that threading of the textile yarn into the twist tube as well as the passage of knots causes considerable difficulties.

SUMMARY OF THE INVENTION

It is the purpose of the present invention to eliminate this disadvantage and to provide a twist tube which is suitable for extremely high revolution speeds of up to 800,000 r.p.m. and more, which at the same time renders possible threading of the textile yarn and the passage of knots without difficulties.

According to the present invention, a twist tube comprises a transverse thread-guide pin arranged in the axial bore of an enlarged cylindrical portion of the twist tube, which is characterized in that the axial bore of the enlarged portion has an oblong or ellipsoidal cross-section and in that two parallel wall portions of the bore situated opposite each other have holes or grooves in which the ends of the thread-guide pin are fitted and fixed.

Advantageously, the axis of the thread-guide pin may be displaced laterally with respect to the longitudinal axis of the twist tube by a fraction of the thickness of the pin.

Furthermore, the enlarged cylindrical part may comprise, as a further threading help, opposed coaxial openings having an axis crossing the axis of the thread-guide pin but displaced in the direction of the main part of the twist tube by a fraction of the thickness of the pin.

The twist tube according to the present invention has the advantage that, on the one hand, even when the twist tube has very small dimensions, there is sufficient space in the enlarged portion of the twist tube — because of the oblong shaped bore — to enable the textile yarn to be threaded, i.e. to render possible one wrapping around the thread-guide pin and also the passage of knots. On the other hand, the bore of oblong shape has also the advantage that the parallel portions of the bore situated opposite each other and the bores or grooves provided in these wall portions, in which the two ends of the pin are supported, lie relatively near each other. Thereby, the danger of breakage of the pin because of the high centrifugal forces that arise is considerably reduced.

DESCRIPTION OF THE DRAWINGS

Two examples of the present invention will now be described in more detail with reference to the accompanying drawings wherein.

Figure 1:
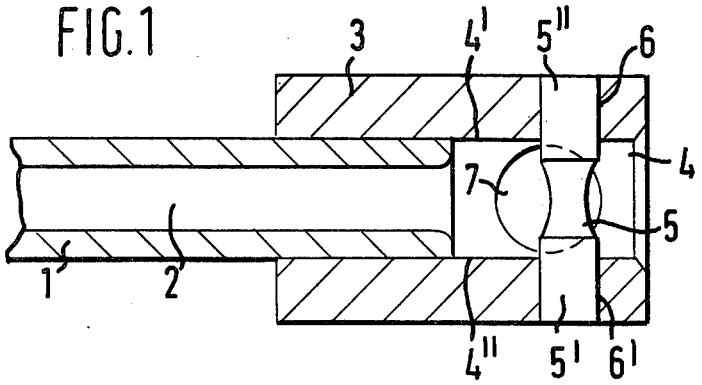
FIG. 1 shows an end portion of a twist tube in longitudinal section parallel with the axis of the thread-guide pin.
Figure 2:
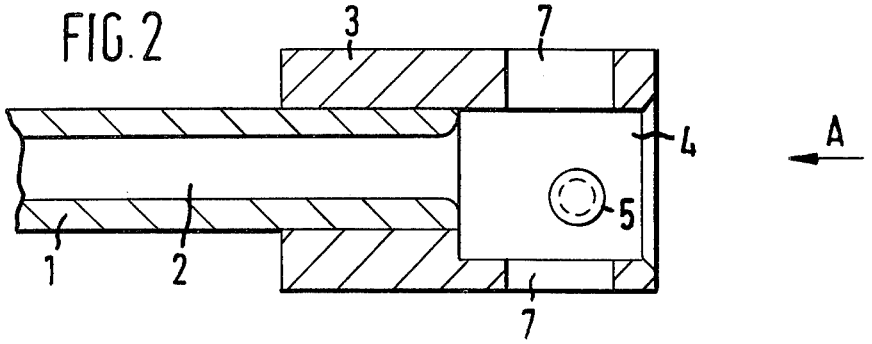
FIG. 2 shows the end portion of the twist tube of FIG. 1 in central longitudinal section perpendicular to the axis of the thread-guide pin.

The portion of the twist tube shown in FIGS. 1 and 2 consists of steel tube 1 and an enlarged cylindrical head 3 of aluminum fitted round the end thereof and projecting beyond the end. The steel tube has an outer diameter of 2 mm and a longitudinal bore 2 having a diameter of 1 mm. The portion of the enlarged head 3 projecting beyond the tube 1 has an outer diameter of 4 mm and has a longitudinal bore 4 with an oblong cross-section, the minor axis of which is 2 mm and the major axis of which is 2.78 mm. The oblong section of the bore 4 has straight parallel sides 4', 4'' and arcuate ends.

Into bores 6, 6' extending transversely between the sides 4', 4'' of the bore 4 are fitted the ends 5', 5'' of a cylindrical thread-guide pin 5 and are fixed there by means of an adhesive. The pin 5 consists of sapphire, and its ends 5', 5'' have a diameter of 1 mm whereas the diameter of the centre of a central, concave portion is 0.7 mm. The axis of the pin 5 lies on the minor axis of the bore 4 and bisects the major axis thereof, so that the bore 4 facilitates threading of the yarn.

Figure 3:
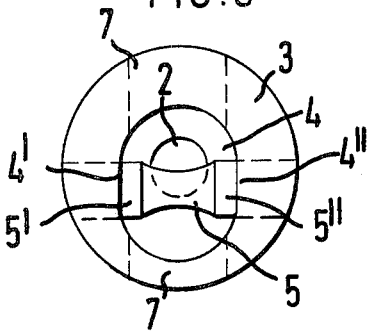
FIG. 3 shows a view of the twist tube in the direction of arrow A in FIG. 2.
Figure 4:
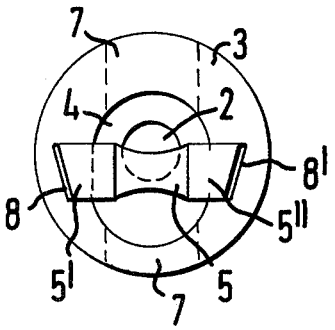
FIG. 4 shows a view analogous to that in FIG. 3, of a modified embodiment of the twist tube of FIGS. 1 to 3.

As shown in FIGS. 2 and 3, the pin 5 is laterally displaced with respect to the longitudinal axis of the twist tube by approximately half its thickness so that the minimum diameter of the concave portion of the pin 5 over which the textile yarn passes is only displaced from the longitudinal axis of the twist tube by the order of half the yarn thickness.

As shown in FIGS. 1 and 2, the head 3 furthermore is provided with a diametral bore which provides opposed openings 7 having an axis perpendicular to the pin axis but displaced towards the end of the tube 1, which further facilitates threading of the yarn. The axis of the openings 7 lies on the major axis of the bore 4.

In the modified embodiment of the twist tube shown in FIG. 5, the head 3, instead of the bores 6, 6', comprises, at each of the oppositely situated, parallel wall portions 4' 4'' of the bore 4, a groove 8, 8' extending axially along the head 3. The two ends 5', 5'' of the thread guide pin 5 are fitted and fixed by means of an adhesive respectively in the grooves 8, 8'.

I claim:

1. A twist tube for a false-twist device for texturing textile yarns, comprising a main tubular portion, a diametrally enlarged tubular portion constituting a comparatively short extension of one end of said main tubular portion, said enlarged tubular portion providing a widened continuation of the passage through said main tubular portion and having a bore extending from said one end to the extremity of said twist-tube, said bore being uniformly oblong in cross-section with major and minor axes perpendicular to one another and with parallel sides perpendicular to the minor axis of said cross-section, said enlarged tubular portion being formed on opposite sides with spaces for receiving respectively the ends of a thread-guide pin and opening into said parallel sides of said bore, and a cylindrical thread guide pin having its ends fitted and fixed in said spaces with the axis of said pin perpendicular to the major axis of said bore, said major and minor axes being substantially longer than the diameter of the passage through said main tubular portion and being dimensioned and disposed to facilitate the threading of yarn passing through the twist-tube and wound once round said pin.

2. A twist-tube according to claim 1, in which the the axis of said thread-guide pin is mounted so that it is displaced laterally with respect to the longitudinal axis of said main tubular portion by a fraction of the diameter of each said end of said pin.

3. A twist-tube according to claim 1, in which said parallel sides of said oblong bore are joined by arcuate sides, and said comparatively short extension is formed with opposed co-axial openings respectively extending from outside said extension to open into said oblong bore at the arcuate sides thereof, the axis of said co-axial openings being perpendicular to the axis of said thread-guide pin but displaced towards said end of said main tubular portion by a fraction of the diameter of said ends of said pin, said openings being dimensional further to facilitate said threading of yarn.

* * * * *